United States Patent [19]

Heine

[11] Patent Number: 4,700,607

[45] Date of Patent: Oct. 20, 1987

[54] FIBER SPOOL APPARATUS

[75] Inventor: William M. Heine, Alexandria, Va.

[73] Assignee: Atlantic Research Corporation, Alexandria, Va.

[21] Appl. No.: 28,663

[22] Filed: Mar. 20, 1987

[51] Int. Cl.[4] ..... D04C 3/18; D04C 3/14

[52] U.S. Cl. ..... 87/57; 87/22; 87/56; 242/128

[58] Field of Search ..... 87/20–22, 87/55–57, 61, 33; 242/128, 129.8, 156, 156.2; 57/352

[56] References Cited

U.S. PATENT DOCUMENTS

| | | | |
|---|---|---|---|
| 1,614,099 | 1/1927 | Blaisdell | 87/55 |
| 2,049,385 | 7/1936 | Krissiep | 87/55 |
| 2,167,930 | 8/1939 | Krissiep | 87/21 X |
| 2,911,875 | 11/1959 | Ostermann et al. | 87/21 |
| 3,038,367 | 6/1962 | Karg et al. | 87/22 |
| 3,426,804 | 2/1969 | Bluck | 87/33 X |
| 3,817,147 | 6/1974 | Richardson | 87/57 |
| 4,312,261 | 1/1982 | Florentine | 87/33 |
| 4,529,147 | 7/1985 | Bull et al. | 87/57 X |

*Primary Examiner*—John Petrakes

*Attorney, Agent, or Firm*—Quaintance, Murphy & Presta

[57] ABSTRACT

The fiber spool apparatus comprising a main fiber spool mounted within an elongated housing of the fiber carrier. Fiber from the main spool is fed outwardly around a guide and through an aperture extending from the end portion to the middle portion of a take-up spool that is mounted on a cover that is removably mounted on the upper end of the housing. The longitudinal or rotational axis of the take-up spool is generally perpendicular to the lognitudinal or rotational axis of the main spool and the housing. The take-up spool is provided iwth a pretension spring assembly for allowing the fiber to be fed through the take-up spool to the braiding apparatus and to maintain a predetermined tension on the fiber during such feeding. The carrier housing may be provided with wheels or the like at the bottom end thereof for allowing the carrier to be easily moved during the braiding process.

11 Claims, 5 Drawing Figures

FIBER SPOOL APPARATUS

BACKGROUND OF THE INVENTION

The present invention relates to a spool apparatus for feeding a fiber to a braiding machine or the like and, more particularly, to such apparatus wherein a predetermined tension is maintained on the fiber to prevent it from sagging as the spool apparatus traverses the braider bed or the like.

In general, a braiding process is characterized by the fact of all fiber carriers being in motion to result in intertwined fibers. Multi-ply braiding machines use a matrix array of carriers capable of alternate row and column position shifts. Reversal of the direction of row and column motion during a complete shift cycle produces the intertwining of fibers. Production of complex shapes is possible by adjusting the length of travel (number of spaces shifted) of each row or column.

Multi-ply braiding concepts and machines are disclosed in the patents to Bluck, U.S. Pat. No. 3,426,804, and Florentine, U.S. Pat. No. 4,312,261, the teachings of which are incorporated herein by reference. In the Bluck and Florentine patents, each row and column consists of discrete eyelets or carrier blocks. In other machines presently in use, row motion is accomplished by shifting grooved track members containing fiber carriers. Column motion consists of shifting the discrete fiber carriers. Each of the fiber carriers may be provided with a fiber supply spool from which fiber is fed from the carrier to the braiding apparatus. During movement of the fiber carriers, it is important to maintain a predetermined tension on the fiber being fed to the braiding apparatus for the purpose of taking up slack therein and preventing the fiber from sagging, which can result in interference with other fibers and jamming or malfunctioning of the braiding apparatus.

Although there are presently available spool assemblies for such fiber carriers for taking up slack in the fiber as it is fed to a two-ply braiding apparatus or the like, such assemblies have generally been difficult to manufacture in small sizes suitable for fiber carriers in multi-ply braiding machines or the like. Carriers for supply bobbins and braiding machines are disclosed in the patents to Bull et al, U.S. Pat. No. 4,529,147 and Karg et al, U.S. Pat. No. 3,038,367, the teachings of which are incorporated herein by reference. In the Bull patent, the carrier has a raisable circular cap with a vertical extension which controls the tension of the fiber supply. The Karg patent also has tension adjusting properties, but it along with the Bull patent utilizes carriers that are too long vertically, or require an unacceptable large amount of horizontal space.

Accordingly, a need has arisen for such a fiber spool apparatus that is simple in construction, compact and reliable in operation. The spool apparatus of the present invention fills this need.

SUMMARY OF THE INVENTION

The fiber spool apparatus of the present invention generally comprises a main fiber spool mounted within an elongated housing of the fiber carrier. Fiber from the main spool is fed outwardly around a guide and through an aperture extending from the end portion to the middle portion of a take-up spool that is mounted on a cover that is removably mounted on the upper end of the housing. The longitudinal or rotational axis of the take-up spool is generally perpendicular to the longitudinal or rotational axis of the main spool and the housing. The take-up spool is provided with a pre-tension spring assembly for allowing the fiber to be fed through the take-up spool to the braiding apparatus and to maintain a predetermined tension on the fiber during such feeding. The carrier housing may be provided with wheels or the like at the bottom end thereof for allowing the carrier to be easily moved during the braiding process.

Because the tensioning mechanism is oriented horizontally above the fiber source rather than to the side, the spool apparatus of the present invention can be produced in a compact size that is useful for a fiber carrier or the like in a braiding machine. Also, the mounting of the take-up spool on a removable cover allows for easy replacement of the main spool when the fiber thereon is used up. The spool apparatus of the present invention and its components may be made of any suitable materials, such as metal, plastic or the like.

DESCRIPTION OF THE PREFERRED EMBODIMENT

Figure 1:
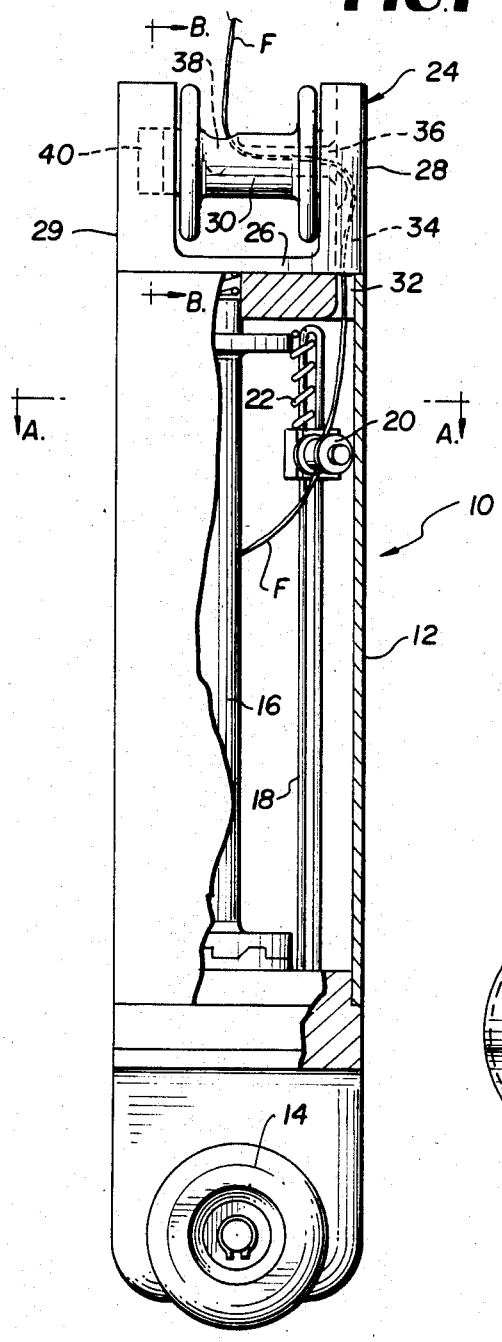
FIG. 1 is a side elevational view, with parts broken away and parts shown in section, of a fiber spool apparatus constructed in accordance with the principles of the present invention.

FIG. 1 illustrates a fiber carrier 10 for a braiding machine or the like, comprising a housing 12 having wheels 14 or the like on the bottom thereof for the purpose of enabling the carrier 10 to be moved in a predetermined manner in the braiding machine, as hereinbefore explained.

A main supply spool 16 having fiber F wound thereon for feeding to a braiding assembly or the like is removably mounted in any suitable manner within the elongated housing 12 for rotation about an axis that is substantially parallel to the longitudinal axis of the housing. An elongated, preferably double rod support 18 is mounted within the elongated housing 12 and extends longitudinally therein adjacent to the main supply spool 14. A fiber guide member 20 of any suitable construction is slidably mounted on the double rod support 18 and is secured to a spring 22 mounted on the support so as to provide a flexible or cushioned mount for the guide member. The double rod support 18 serves to prevent the fiber guide member 20 from twisting thereon. Preferably, the fiber guide member 20 is rotatable to facilitate the travel of the fiber F in engagement therewith.

Figure 2:
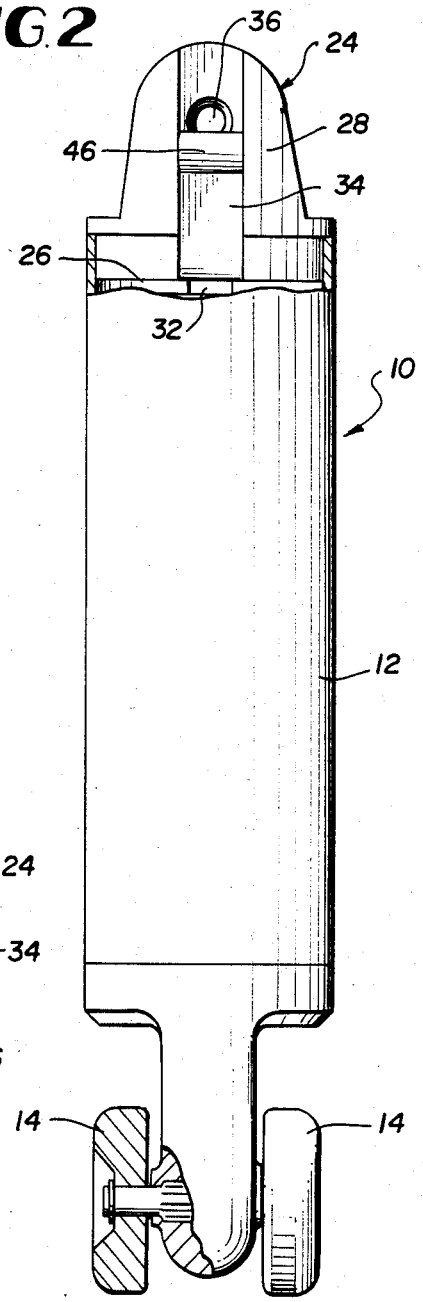
FIG. 2 is a front elevational view, with parts broken away and parts shown in section, of the fiber spool apparatus shown in FIG. 1.

As shown in FIGS. 1 and 2, a cap or cover assembly 24 is removably mounted on the upper end of the elongated housing 12. Cap assembly 24 comprises a bottom portion 26 covering the upper end of the housing 12 and a pair of upstanding side portions 28,29 which rotatably support in any suitable manner a take-up spool 30 having an axis of rotation that is generally perpendicular to the axis of rotation of the main supply spool 16. The bottom portion 26 of the cap member 24 is provided with an aperture 32 therethrough that is located near the upper portion of the double rod support 18 in the housing 12. The side portion 28 of the cap member 24 is provided with an upwardly extending channel 34 that is vertically aligned with the aperture 32 in the bottom portion 26, as shown in FIG. 2.

Figure 3:
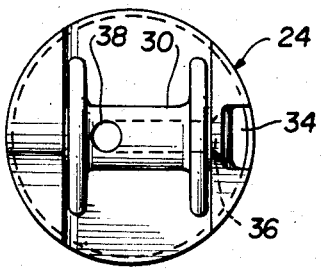
FIG. 3 is a top plan view of the fiber spool apparatus shown in FIG. 1.
Figure 4:
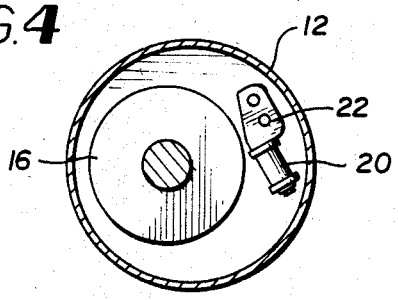
FIG. 4 is a sectional view taken substantially along line A—A in FIG. 1.

An aperture 36 is provided in the side portion 28 of the cap member 24 near the upper end of the channel 34. The aperture 36 is in alignment with a channel 38 in the take-up spool 30 that extends from the end portion thereof to the middle portion in the manner shown in FIGS. 1 and 3. It will be noted, therefore, that fiber F may be advanced from the main supply spool 16 around the guide member 20, through the aperture 32, the channel 34 and the aperture 36 in the cap member 24, and through the channel 38 in the take-up spool 30 in the manner shown in FIG. 1.

Figure 5:
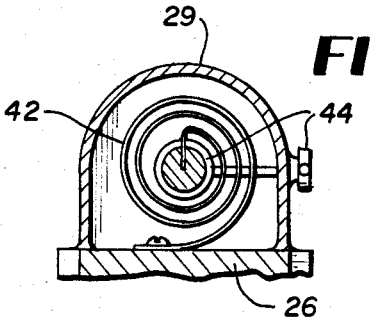
FIG. 5 is a sectional view taken substantially along line B—B in FIG. 1.

The side portion 29 of the cap member 24 preferably is provided with a spring mechanism 40 of any suitable construction that is operatively connected to the take-up spool 30 for the purpose of applying a biasing force to the take-up spool in a direction of rotation to wind fiber F back onto the take-up spool when there is slack therein. As shown in FIG. 5, the spring assembly 40 may comprise a coil spring 42 and a releasable ratchet mechanism 44 that allows the take-up spool to be rotated in a direction to advance fiber F toward the braiding apparatus for the purpose of pre-tensioning the spring 42.

In the operation of the fiber spool apparatus of the present invention, fiber F from the main supply spool in the elongated housing 12 is advanced upwardly around the guide member 20 and through the aperture 32, channel 34 and aperture 36 in the cap member 24 that is removably mounted on the upper end of the housing 12. The fiber F is then advanced through the channel 38 in the take-up spool 30 from the end portion to the middle portion thereof and then upwardly or outwardly where its free end is secured to the upper end of the braider (not shown). This path for the fiber F is clearly shown in FIG. 1.

Thereafter, the ratchet mechanism 44 of the take-up spool 30 is released to allow the pre-tensioned spring 42 to apply a rotational force to the take-up spool to tension the fiber F extending to the braider. During the braiding operation, as the fiber carrier 10 traverses the braider bed or the like, the take-up spool 30 takes up any slack in the fiber to prevent it from sagging. As fiber F is needed for braiding, it is first removed from the take-up spool 30 and then from the main spool 16.

In order to facilitate passage of the fiber F from the channel 34 of the side portion 28 of the cap member 24 into the channel 38 in the take-up spool 30, a curved portion 46 is provided on the side portion 28, as shown in FIGS. 1 and 2, for the purpose of reducing friction on the fiber F as it is bent through an approximately 90° angle into the take-up spool channel 38.

What is claimed is:

1. A fiber spool apparatus for braiding apparatus or the like comprising:

an elongated housing having an open end;

a fiber supply spool removably mounted within said housing for rotation about an axis that is substantially parallel to the longitudinal axis of said housing;

a cap member removably mounted on said open end of said housing;

a take-up spool rotatably mounted on said cap member for rotation about an axis that is substantially perpendicular to the axis of rotation of said supply spool; said take-up spool comprising an end portion and a middle portion, and having an internal channel extending from said end portion to said middle portion thereof;

means for guiding fiber from said supply spool through said internal channel in said take-up spool, from said end portion to said middle portion thereof, so that fiber can be fed from said middle portion to the braiding apparatus; and biasing means operatively connected to said take-up spool for maintaining a predetermined tension on the fiber being fed to the braiding apparatus to prevent slack therein.

2. The spool apparatus of claim 1 wherein a guide member is mounted within said housing to guide fiber from said supply spool to said cap member and take-up spool.

3. The spool apparatus of claim 2 wherein said guide member is rotatable and is slidably mounted on an elongated support mounted within said housing.

4. The spool apparatus of claim 3 wherein spring means is connected to said guide member to releasably retain it in a predetermined position on said elongated support.

5. The spool apparatus of claim 1 wherein said cap member has a bottom portion covering said open housing end, and first and second upstanding side portions; said take-up spool being rotatably mounted on and between said first and second side portions.

6. The spool apparatus of claim 5 wherein said first side portion comprises a channel for guiding the fiber to said end portion of said take-up spool.

7. The spool apparatus of claim 1 wherein said biasing means comprises a coil spring, and locking means is operatively connected to said take-up spool to enable it to be releasably locked after it has been rotated to pre-tension said coil spring.

8. The spool apparatus of claim 7 wherein said coil spring and said locking means are mounted on said second side portion of said cap member.

9. The spool apparatus of claim 7 wherein said locking means comprises a ratchet assembly.

10. The spool apparatus of claim 7 wherein a guide member is mounted within said housing to guide fiber from said supply spool to said cap member.

11. The spool apparatus of claim 10 wherein said cap member comprises a channel for guiding the fiber to said end portion of said take-up spool.

* * * * *